United States Patent [19]

Werth

[11] Patent Number: 4,531,805

[45] Date of Patent: Jul. 30, 1985

[54] ELECTRICAL CONNECTOR ASSEMBLY HAVING MEANS FOR EMI SHIELDING

[75] Inventor: Dee A. Werth, Bainbridge, N.Y.

[73] Assignee: Allied Corporation, Morristown, N.J.

[21] Appl. No.: 596,347

[22] Filed: Apr. 3, 1984

[51] Int. Cl.[3] ..... H01R 13/658; H01R 17/12

[52] U.S. Cl. ..... 339/143 R; 339/177 R

[58] Field of Search ..... 339/143 R, 177 R, 177 E, 339/14 R, 89 C, 90 C

[56] References Cited

U.S. PATENT DOCUMENTS

| | | | |
|---|---|---|---|
| 2,762,025 | 9/1956 | Melcher | 339/143 R |
| 2,958,750 | 11/1960 | Lebens | 200/133 |
| 3,099,506 | 7/1963 | Tuchel | 339/143 R |
| 3,171,706 | 3/1965 | Daniels et al. | 339/143 R |
| 3,281,756 | 10/1966 | O'Keefe et al. | 339/89 |
| 3,336,566 | 8/1967 | Barker | 339/143 R |
| 3,408,610 | 10/1968 | Clarkson | 339/8 |
| 3,448,430 | 6/1969 | Kelly | 339/143 R |
| 3,537,065 | 10/1970 | Winston | 339/177 R |
| 3,659,251 | 4/1972 | Fish | 339/143 R |
| 3,910,673 | 10/1975 | Stokes | 339/177 R |
| 3,944,317 | 3/1976 | Oberdiear | 339/143 R |
| 3,990,765 | 11/1976 | Hill | 339/177 R |
| 4,008,943 | 2/1977 | Flatt et al. | 339/111 |
| 4,126,372 | 11/1978 | Hashimoto et al. | 339/177 E |
| 4,243,290 | 1/1981 | Williams | 339/143 R |
| 4,248,492 | 2/1981 | Snyder | 339/89 M |
| 4,290,663 | 9/1981 | Fowler et al. | 339/143 R |
| 4,296,986 | 10/1981 | Herrmann et al. | 339/89 C |
| 4,330,166 | 5/1982 | Cooper et al. | 339/143 R |
| 4,349,241 | 9/1982 | Juris et al. | 339/143 R |
| 4,452,503 | 6/1984 | Forney, Jr. | 339/89 C X |

*Primary Examiner*—Gil Weidenfeld
*Assistant Examiner*—Steven C. Bishop
*Attorney, Agent, or Firm*—C. D. Lacina

[57] ABSTRACT

A continuous 360° electrically conductive seal about the back shell (30) of an electrically conductive connector shell (20) having teeth extending aftwardly from its end face (34) and around the braid shield (46) of a coaxial-type cable (40) connected to the back shell by an accessory boot (50) protects signal carrying conductors from EMI entry and the surrounding area from EMI leakage. A frusto-conical wall including an electrically conductive annular wall portion, such as provided by the inner wall (100) of an accessory ferrule (56), or of an electrically conductive annular cap (68, 78, 86) mounted in the ferrule is interference fit about the toothed end face of the connector shell so as to overlap and completely encircle the back shell at a point inwardly of the valleys (36) of the teeth.

23 Claims, 13 Drawing Figures

ELECTRICAL CONNECTOR ASSEMBLY HAVING MEANS FOR EMI SHIELDING

This invention relates to an electrical connector assembly having means for shielding the assembly from electromagnetic interference (EMI).

In recent years a need has developed that electrical connector assemblies provide effective shielding against EMI to signal-carrying conductors and, in certain military applications, to withstand servere EMI conditions caused by or generated by electro-magnetic pulses (EMP). The protect the signal-carrying conductors from external EMI effects and the surrounding area from EMI leakage, both shielded cable and internal ground straps have been used. Electrical connectors satisfying U.S. military standards (e.g., MIL-C-38999, MIL-C-26482, etc.) utilize electrically conductive shells having external thread on its back shell for threadably connecting with internal thread of an accessory boot for supporting the cable to the shell and a continuous plurality of aftwardly extending V-shaped teeth around its end face which match with accessory teeth for non-rotatably locking the two together.

However, it has been found that electro-magnetic and radio frequency signals can enter or leave an otherwise shielded plug and receptacle electrical connector system through the connector threads and through slight mismatch between the locking teeth. Hence, the importance of maintaining a continuous 360° electrically conductive shield around the cable connection at the rearward end portion of the connector assembly is now recognized.

Accordingly, one object of the present invention is to provide an electrical connector designed to meet EMI shielding criteria while continuing to satisfy presently established electrical and mechanical performance specifications. Another object of the present invention is provision of an EMI shielding arrangement which provides a continuous 360° seal of electrically conductive material between the back shell and the cable braid around the termination of the cable to the shell. Still another object of the invention is provision of an electrical connector assembly which utilizes metal-to-metal abutment between a pair of shield members and a complementary internal electrically conductive adapter to improve EMI shielding characteristics of the connector. Yet another object is to provide an electrically conductive cap which is specially configured to cover the polarizing teeth on the end face of a connector back shell to obtain improved EMI shielding.

In furtherance of these and other objects, the electrical connector assembly of the present invention comprises an electrically conductive shell of the type having a mating front portion, a generally cylindrical rear portion or back shell having a transverse end face, an electrical contact carried in the shell for mating, an accessory boot of electrically conductive material mounted to the back shell, means for shielding the shell against electro-magnetic interference, and a coaxial-type cable having a conductive braid shield encircling a center conductor passing through the accessory boot and terminated to the contact, the accessory boot having an axial end face confronting the transverse end face, and means connecting the cable to the back shell.

In accordance with the present invention, shield means are provided for providing a continuous 360° electrically conductive seal around the back shell to protectively shield the signal carrying conductors against electro-magnetic interference. The shield means are comprised of a frusto-conical wall of electrically conductive material being in electrical circuit relation to the shield, the frusto-conical wall having an annular wall portion thereof overlapping and encircling the back shell in an interference fit. In one aspect, an interior wall of the accessory boot includes the frusto-conical wall and circumscribes the back shell. In another aspect, a separate annular cap of electrically conductive material includes the frusto-conical wall, the cap being disposed in the accessory and including an interior or an exterior annular wall portion which inscribes or circumscribes the back shell at a location spaced from the transverse end face thereof. In a further aspect, a separate annular cap of electrically conductive material and including a coaxial pair of sleeves defines a frusto-conical throat which simultaneously inscribes and circumscribes the back shell as described before. In a situation where the V-shaped teeth extend rearwardly from the end face, the annular wall portion encircles the back shell at a location inwardly of the valleys of the teeth.

One way of carrying out the invention is described in detail below with reference to the drawings which illustrate specific embodiments of this invention, in which.

Figures 1, 2, 3, 4, 5, 6:
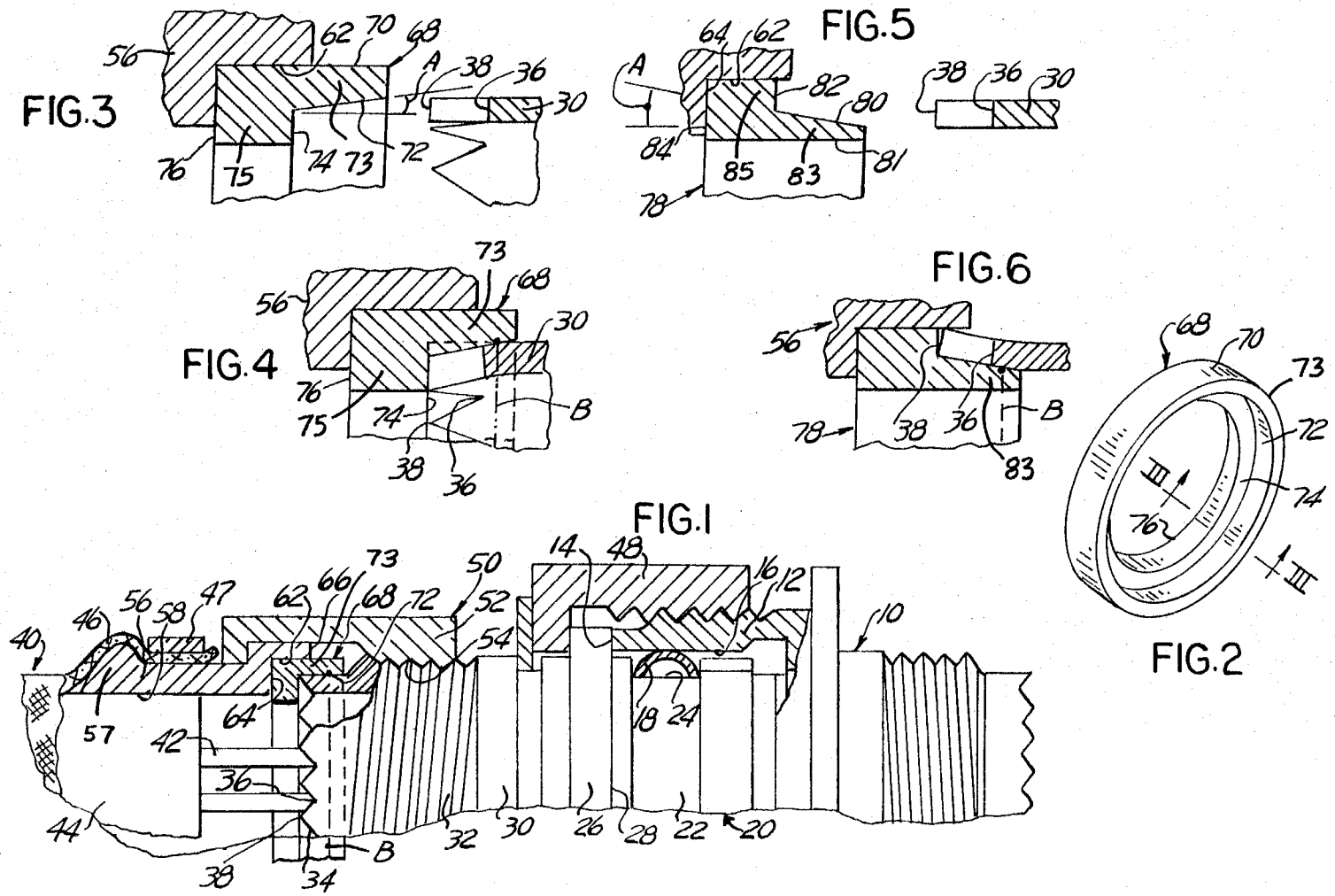
FIG. 1 shows a partial cross-section of an electrical connector assembly having an arrangement providing EMI shielding around the back shell of a plug connector.
FIG. 2 shows an annular cap for providing continuous EMI shielding around the back shell of FIG. 1.
FIG. 3 shows in cross-section a portion of the annular cap positioned prior to assembly onto the back shell with the cap being shown as taken along lines III—III of FIG. 2.
FIG. 4 shows an enlarged cross-section of FIG. 1 with the annular cap of FIG. 2 assembled to the back shell.
FIG. 5 shows in cross-section an alternate embodiment of an annular cap for providing EMI shielding to the back shell and prior to assembly thereto.
FIG. 6 shows in cross-section the annular cap of FIG. 5 assembled to the back shell.

Referring now to the drawings and particularly to FIG. 1, an electrical connector assembly includes a plug connector member 20 terminating a shielded cable 40, a receptacle connector member 10, a coupling ring 48 rotatably mounted to the plug connector member for coupling the connector members together, and a grounding strap 18 for shielding the electrical connector assembly from EMI. The cable 40 comprises one or more center conductors 42, a dielectric body 44 surrounding the conductors, and a conductive braid shield 46 surrounding the dielectric. An accessory boot 50 is mounted to the plug connector 20 for supporting the cable thereto. Although not shown, a like shielded cable and boot would be mounted to the receptacle connector.

Plug connector member 20 comprises an electrically conductive metallic shell having a mating forward end portion 22 having an outer periphery 24, a conductor receiving back shell or rearward end portion 30, and a radial flange 26 medially of its end portions and having an end wall 28 facing forwardly. The back shell 30 includes external thread 32 therearound and a transverse end face 34 comprising a plurality of aftwardly extending V-shaped teeth or serrations having valleys 36 and peaks 38, the teeth being provided to facilitate non-rotational connection thereto of an auxiliary accessory. In some applications the end face 34 could be flat. Although not shown, a dielectric insert which supports one or more electrical contacts for termination to respective of the center conductors is mounted in the plug conductor member.

Receptacle connector member 10 is compatible for mating to plug connector member 20 and will not be described since its details would be understood by one of ordinary skill in the art of assembling electrical connectors. It might be noted, however, that the receptacle includes a generally cylindrical shell 12 of electrically conductive material which, when mated to the plug shell, has a forward end face 14 abutting the end wall 28 of flange 26 and its inner surface 16 compressing the grounding strap 18 radially inward against the outer periphery 24 of the plug shell. Also, and for the same reasons to be described, the rearward end face of its back shell includes a plurality of aft-extending V-shaped serrations.

Accessory boot 50 includes a generally cylindrical ferrule 56 having a back face 57 and being adapted to slidably insert between the braid shield 46 and the dielectric 44 and a coupling nut 52 rotatably mounted thereto, the ferrule having a rearward bore 58 clearance fitting about the dielectric and the coupling nut 52 being provided with internal thread 54 for engaging external thread 32 on the back shell 30.

To assure complete EMI shielding of the cable where joined to the plug connector, a continuous 360° electrically conductive seal is provided between the braid, the accessory boot and the back shell. An end portion of the braid shield is fitted tightly about the ferrule and a clamping ring 47 is crimped radially inward and therearound to both secure the braid to the ferrule and support the cable to the back shell when the accessory boot has been positioned relative to the back shell of the plug connector member, the inward crimping forming a continuous 360° electrically conductive seal between the braid and ferrule.

Further, the ferrule 56 includes a front face 66 and a stepped bore extending coaxially between the front face and back face 57. The stepped bore comprises the rearward bore 58 and a forward bore 62 with the transition between the bores defining a transverse end wall 64 spaced axially rearward from the front face 66, the forward bore 62 and the end wall 64 describing a cylindrical pocket.

An annular cap 68 of electrically conductive material is disposed in the pocket in an interference fit, the cap including a cylindrical sleeve 73 having an interior annular wall portion 72 thereof overlapping and completely encircling the back shell at a shell location shown by the dotted line indicated at "B" and inwardly of the valleys 36 of the V-shaped teeth, the annular wall portion making a continuous 360° metal-to-metal interference engagement with the back shell.

FIG. 2 shows a perspective of annular cap 68, the annular cap being unitary in construction and adapted to be mounted within the pocket. The cap comprises the cylindrical sleeve 73 and an annular flange 75 extending radially inward therefrom, the sleeve having an outer wall 70 adapted to interference fit against the sidewall forming the forward bore 62 and an inner wall 72 for encircling the back shell. The annular flange 75 defines an axially facing interior end wall 74 and exterior end wall 76, the interior end wall 74 for abutting the peaks 38 of the teeth and the exterior end wall 76 for abutting the end wall 64 of the pocket. The inner wall 72 is frustoconical in cross-section and includes the annular wall portion for encircling the teeth, the diameter of the annular wall portion having a dimension that is slightly less than the outer diameter defining the periphery of the back shell.

FIG. 3 shows a cross-section of the annular cap 68 positioned adjacent to peaks 38 and valleys 36 comprising the toothed end face 34 of the back shell 30 prior to assembly of the cap thereto. For clarity, the rest of the connector assembly has been omitted. Frusto-conical wall 72 is disposed at an angle indicated by "A" relative to the center axis of the sleeve 73.

FIG. 4 shows the annular cap 68 assembled to and sealing about the back shell. As a result of the cap being interference fit and circumscribed around the back shell, the back shell slightly deflects radially inward, the teeth abut the interior end wall 74, and the frustoconical annular wall portion encircles the back shell inwardly of its end face 34 and around a line shown by "B" longitudinally inward of valleys 36 to cover the teeth.

FIG. 5 shows an alternate annular cap 78 of electrically conductive material being interference fit in the pocket. This cap comprises a cylindrical sleeve 83 including an interior wall 81 and an exterior frusto-conical wall 80, and an annular flange 85 extending radially outward and having an axially facing forward end wall 82 and rearward end wall 84, the cap being mounted in the forward bore 62 so that rearward end wall 84 thereof is abutting the transverse end wall 64 of ferrule 56. The frusto-conical wall 80 includes an annular wall portion being adapted to interference fit and be inscribed within the back shell at a location longitudinally inward of the valleys 36 of the V-shaped teeth. Frusto-conical wall 80 is disposed at an angle indicated by "A" relative to the center axis of the cap.

FIG. 6 shows the annular cap 78 inscribed in the back shell 30 resulting in the back shell deflecting radially outward, the peaks 38 abutting the forward end wall 82, and the annular wall portion encircling the back shell rearwardly of its end face 34 around a line shown by "B" and longitudinally inward of valleys 36 to cover the teeth.

Figure 7:
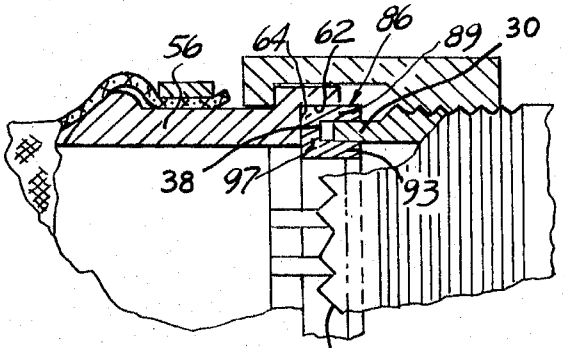
FIG. 7 shows a connector back shell having an another embodiment of an annular cap for providing EMI shielding.

FIG. 7 shows an alternate annular cap 86 of electrically conductive material mounted in the forward bore of ferrule 56, the cap including an annular throat defined between a pair of generally cylindrical sleeves 89, 93 extending coaxially from their connection to a common base 97. Preferably cap 86 would be interference fit in the forward bore 62 of ferrule 56.

Figure 8:
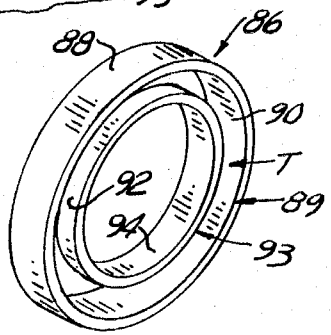
FIG. 8 shows a perspective view of the cap of FIG. 7.

FIG. 8 is a perspective view of annular cap 86 and showing the annular throat, indicated by the letter "T", being positioned adjacent the back shell. The coaxial sleeves 89, 93 include, respectively, an inner wall 90, 92 and an outer wall 88, 94 with the inner walls confronting and being frusto-conical relative to the center axis, each frusto-conical wall being disposed by an angle indicated at "D".

Figure 9:
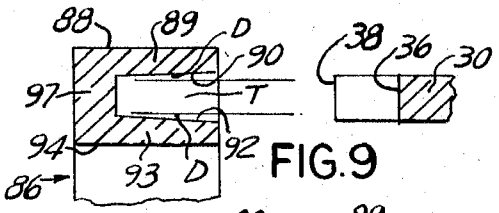
FIG. 9 is a cross-section of the cap of FIG. 7 prior to assembly to the back shell.

FIG. 9 is a cross-section of annular cap 86 showing the annular cap 86 positioned adjacent to the toothed end face 34 of the back shell 30 prior to assembly thereto. For clarity, the rest of the connector assembly has been omitted. The inner walls 90, 92 of the outer sleeve 89 and the inner sleeve 93 have, respectively, an annular wall portion thereof confronting and annularly separated to define the annular throat "T", the base 97 including an outer end wall 98 adapted to abut the end wall 64 in the pocket of ferrule 56 and an interior wall 96 adapted to abut the peaks 38 of the V-shaped teeth.

Figure 10:
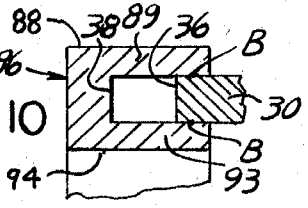
FIG. 10 shows a cross-section of the cap of FIG. 7 assembled to the back shell.

FIG. 10 shows the assembly of the annular cap 86 and the annular wall portions encircling the back shell to form an electrically conductive seal at a point as shown at "B" inwardly of the valleys 38 of the teeth.

Figure 11:
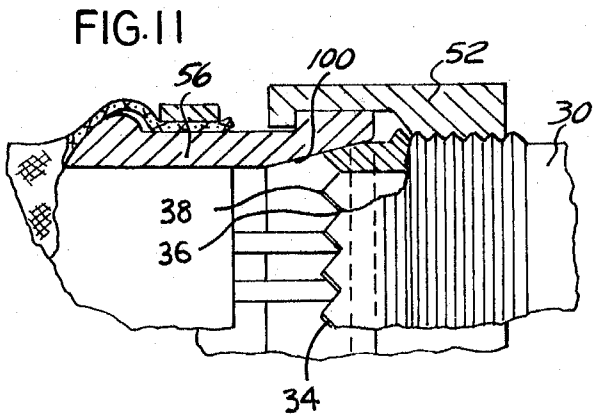
FIG. 11 is a partial cross-section of an alternate electrical connector assembly providing EMI shielding to the back shell.

FIG. 11 shows an alternate configuration wherein the ferrule 56 of the accessory boot 50 includes a frustoconical annular wall portion 100 having a diameter adapted to encircle with an interference fit the back shell at a location spaced inwardly of the valleys of the V-shaped teeth.

Figure 12:
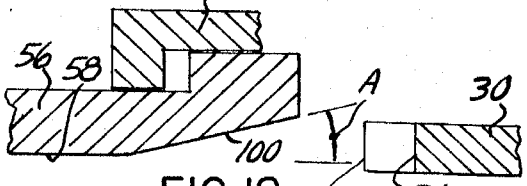
FIG. 12 is an enlarged cross-section of the alternate embodiment of FIG. 11 prior to assembly.

FIG. 12 shows the ferrule positioned for assembly to the back shell. For clarity, the remainder of the connector assembly has been omitted.

Figure 13:
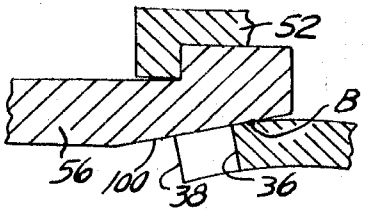
FIG. 13 is an enlarged cross-section of the alternate embodiment of FIG. 12 assembled to the back shell.

FIG. 13 shows the ferrule interference fit about the back shell with the annular wall portion thereof being interference fit in a continuous 360° electrically conductive seal at a point inwardly of the valleys 36 of the V-shaped teeth, and the back shell deflecting radially inward.

I claim:

1. An electrical connector assembly comprising a shell of electrically conductive material including a generally cylindrical back shell having a transverse end face, a cable having a center conductor encircled by a conductive braid received within and extending outwardly from said back shell, means including an accessory boot of an electrically conductive material for connecting the cable to the back shell, and means for shielding the center conductor against electro-magnetic interference, characterized by said means for shielding providing a continuous 360° electrically conductive seal between the conductive braid and said back shell and comprising a ferrule of electrically conductive material in electrical circuit relation to the cable braid and a sleeve of electrically conductive material in electrical circuit relation to said braid and said ferrule and having a frusto-conical annular wall portion thereof overlapping and completely encircling the back shell, the diameter of said annular wall portion having a dimension sized to interference fit relative to the back shell at a location spaced longitudinally inward from its transverse end face whereby said annular wall portion completes a continuous electrical seal and circuit path around and between the back shell.

2. The assembly as recited in claim 1 wherein said annular wall portion defines the interior surface of said ferrule.

3. The assembly as recited in claim 1 wherein said ferrule includes a transverse end wall, and said sleeve extends from abutment against said end wall, said sleeve having an inner wall and an outer wall with one said inner wall and said outer wall comprising said frusto-conical annular wall portion.

4. The assembly as recited in claim 3 wherein said inner wall comprises said frusto-conical annular wall portion, the diameter of said annular wall portion having a dimension greater than the diameter defining the outer periphery of said back shell to circumscribe the back shell at a point longitudinally inward of the end face thereof and form a continuous electrically conductive seal therearound.

5. The assembly as recited in claim 3 wherein an annular base extends from said sleeve, said base defining an axially facing forward and rearward end wall, said rearward end wall abutting the transverse end wall of said ferrule and the forward end wall abutting the transverse end face of the back shell.

6. The assembly as recited in claim 5 wherein said sleeve and annular base are integral.

7. The assembly as recited in claim 5 wherein said ferrule includes a front face and a bore extending rearwardly therefrom to said transverse end wall to form a cylindrical pocket, said inner wall comprises said frusto-conical annular wall portion, and said outer wall has a dimension slightly greater than said bore so as to interference fit therewithin.

8. The assembly as recited in claim 6 wherein said ferrule includes a bore and said annular base is at the rearward end of said sleeve and extends radially outward therefrom, the annular base having its outer periphery interference fit within the bore.

9. The assembly as recited in claim 5 wherein a plurality of V-shaped teeth extend axially rearward from the transverse end face of said back shell, and the annular wall portion of said sleeve conductively seals the back shell at a point longitudinally inward from valleys defining the teeth.

10. The assembly as recited in claim 9 wherein the forward end wall of the base is abutting the peaks of the plurality of teeth.

11. The assembly as recited in claim 5 and further including a second cylindrical sleeve having a frusto-conical wall including a second annular wall portion, each of said sleeves extending coaxially from said base to form an annular throat, the second cylindrical sleeve being interior and the throat being adapted to inscribe and circumscribe with an interference fit about the inner and outer periphery of the back shell at a point inwardly of the end face thereof.

12. The assembly as recited in claim 10 wherein said first and second cylindrical sleeves and annular base are integrally formed.

13. An electrical connector assembly comprising a generally cylindrical back shell of electrically conductive material including a transverse end face, a cable having a center conductor encircled by a conductive braid received within and extending outwardly from said back shell, means including an accessory boot of an electrically conductive material for connecting the cable to the back shell, and shield means for shielding the center conductor against electro-magnetic interference, characterized by said shield means providing a continuous 360° electrically conductive seal between the conductive braid and said back shell and comprising a ferrule of electrically conductive material in electrical circuit relation to the cable braid and a sleeve of electrically conductive material in electrical circuit relation to said braid and said ferrule and having a frusto-conical annular wall portion thereof overlapping and completely inscribing the back shell, the diameter of said annular wall portion having a dimension sized to interference fit relative to the back shell at a location spaced longitudinally inward from its transverse end face whereby said annular wall portion completes a continuous electrical seal and circuit path around and between the back shell.

14. An electrical connector assembly for shielding a cable against electro-magnetic interference, said cable having a center conductor encircled by a conductive braid and adapted to have an end portion thereof be disposed within and extend outwardly from said assembly, the assembly comprising a cylindrical back shell of electrically conductive material having a transverse end face, connecting means for connecting the cable to the back shell, and shielding means for shielding the center conductor against electro-magnetic interference, characterized by said shielding means providing a continuous 360° electrically conductive seal between the braid and said back shell and comprising a ferrule of electrically conductive material adapted to be in electrical circuit relation to the cable braid, and a sleeve of electrically conductive material adapted to be in electrical circuit relation to said braid and said ferrule and having a frusto-conical annular wall portion thereof overlapping and completing a continuous 360° seal with the back shell at a location spaced longitudinally inward from its transverse end face, the diameter of said annular wall portion having a dimension sized to interference fit relative to the back shell whereby said annular wall portion completes a continuous electrical seal and circuit path around and between the back shell.

15. The assembly as recited in claim 14 wherein said annular wall portion defines the interior surface of said ferrule.

16. The assembly as recited in claim 14 wherein said ferrule includes a transverse end wall, and said sleeve extends from abutment against said end wall, said sleeve having an inner wall and an outer wall with one said inner wall and said outer wall comprising said frusto-conical annular wall portion.

17. The assembly as recited in claim 16 wherein said inner wall comprises said frusto-conical annular wall portion, and the diameter of said annular wall portion has a dimension greater than the diameter defining the outer periphery of said back shell whereby to circumscribe the back shell at a point longitudinally inward of the end face thereof and to form the continuous electrically conductive seal there around.

18. The assembly as recited in claim 15 wherein an annular base extends from said sleeve, and said base defines a forward and a rearward end wall each facing axially, said rearward end wall abutting the transverse end wall of said ferrule and the forward end wall abutting the transverse end face of the back shell.

19. The assembly as recited in claim 18 wherein said sleeve and said annular base are integral.

20. The assembly as recited in claim 18 wherein said ferrule includes a front face and a bore extending rearwardly therefrom to said transverse end wall to form a cylindrical pocket, said inner wall comprises said frusto-conical annular wall portion, and said outer wall has a dimension slightly greater than said bore so as to interference fit therewithin.

21. The assembly as recited in claim 19 wherein said ferrule includes a bore and said annular base is at the rearward end of said sleeve and extends radially outward therefrom, the annular base having its outer periphery interference fit within the bore.

22. The assembly as recited in claim 18 wherein a plurality of V-shaped teeth extend axially rearward from the transverse end face of said back shell, and the annular wall portion of said sleeve conductively seals the back shell at a point longitudinally inward from valleys defining the teeth.

23. The assembly as recited in claim 22 wherein the forward end wall of the base is abutting the peaks of the plurality of teeth.

* * * * *